US009932711B2

(12) United States Patent
Miessbacher

(10) Patent No.: US 9,932,711 B2
(45) Date of Patent: Apr. 3, 2018

(54) RAIL PAD

(71) Applicant: Semperit AG Holding, Vienna (AT)

(72) Inventor: Herwig Miessbacher, Groβlobming (AT)

(73) Assignee: Semperit AG Holding (AT)

( * ) Notice: Subject to any disclaimer, the term of this patent is extended or adjusted under 35 U.S.C. 154(b) by 216 days.

(21) Appl. No.: 14/787,875

(22) PCT Filed: Apr. 22, 2014

(86) PCT No.: PCT/EP2014/058091

§ 371 (c)(1),
(2) Date: Mar. 8, 2016

(87) PCT Pub. No.: WO2014/177419

PCT Pub. Date: Nov. 6, 2014

(65) Prior Publication Data

US 2016/0194835 A1 Jul. 7, 2016

(30) Foreign Application Priority Data

Apr. 29, 2013 (DE) ..... 10 2013 007 306

(51) Int. Cl.
*E01B 9/42* (2006.01)
*E01B 9/68* (2006.01)

(52) U.S. Cl.
CPC ..... *E01B 9/42* (2013.01); *E01B 9/68* (2013.01); *E01B 9/681* (2013.01); *E01B 9/685* (2013.01); *E01B 9/686* (2013.01)

(58) Field of Classification Search
CPC ... E01B 9/42; E01B 9/68; E01B 9/681; E01B 9/685; E01B 9/686
See application file for complete search history.

(56) References Cited

U.S. PATENT DOCUMENTS 4,971,247 A * 11/1990 Harkus ..... E01B 9/18 238/283
5,203,502 A * 4/1993 Young ..... E01B 9/686 238/264

(Continued)

FOREIGN PATENT DOCUMENTS

| | | |
|---|---|---|
| EP | 2336423 | 6/2011 |
| FR | 2630466 | 4/1988 |

(Continued)

*Primary Examiner* — Jason C Smith
(74) *Attorney, Agent, or Firm* — Price Heneveld LLP

(57) ABSTRACT

Rail pad, in particular for track superstructures, comprising a substantially level intermediate layer having an upper side and a lower side, wherein the upper side is designed for arrangement to a rail and the lower side for arrangement to a sleeper, wherein the upper side and/or the lower side are provided with at least one arrangement region on which the rail or the sleeper can be arranged, wherein the rail pad comprises at least one side region arranged adjacent to the intermediate layer and wherein the side region comprises an engaging section and/or a fastening section, wherein the engaging section is designed for accommodation on the sleeper, and wherein the fastening section is designed to directly and/or indirectly connect to the rail.

10 Claims, 8 Drawing Sheets

(56) References Cited

U.S. PATENT DOCUMENTS

Figure 1:
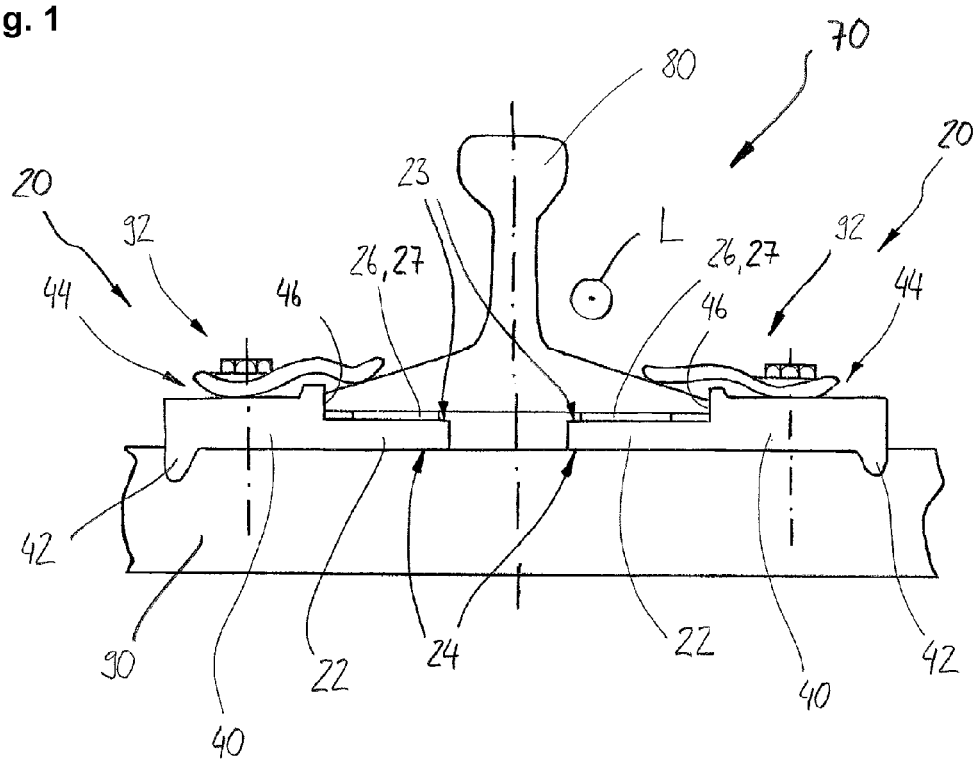

| | | | | | |
|---|---|---|---|---|---|
| 5,692,677 | A * | 12/1997 | Duconseil | E01B 9/686 | 238/107 |
| 6,045,052 | A * | 4/2000 | Besenschek | E01B 9/681 | 238/264 |
| 7,374,109 | B2 * | 5/2008 | Ellerhorst | E01B 9/685 | 238/283 |
| 8,201,751 | B2 * | 6/2012 | Cox | E01B 9/686 | 238/264 |
| 2004/0200906 | A1 * | 10/2004 | Young | E01B 9/68 | 238/264 |
| 2005/0045059 | A1 * | 3/2005 | Osler | E01B 9/68 | 105/199.4 |
| 2013/0233935 | A1 * | 9/2013 | Habel | E01B 5/16 | 238/264 |
| 2016/0194835 | A1 * | 7/2016 | Miessbacher | E01B 9/42 | 238/275 |
| 2016/0376751 | A1 * | 12/2016 | Duong | E01B 9/60 | 238/350 |

FOREIGN PATENT DOCUMENTS

| | | | | |
|---|---|---|---|---|
| GB | 2152119 | | 7/1985 | |
| GB | 2152119 | A * | 7/1985 | E01B 9/68 |
| WO | 09092486 | | 8/2009 | |

* cited by examiner

RAIL PAD

The present invention relates to a rail pad, in particular to track superstructures, a rail pad arrangement, an intermediate layer and a side region.

A large variety of rail fastening systems has been in use to fasten railway rails. For example, superstructure W is a common way of fastening rails to specially designed railway sleepers made of concrete. Each sleeper has two roughly W-shaped recesses into which two matching angular guide plates of steel of plastic are placed. Between these, the rail directly sits on the concrete sleeper—with the entire width of its base—on an intermediate layer about 7 mm in thickness (usually made of plastic or elastomer). Also widely known are rib plates positioned under the rail. In these, the intermediate layers are arranged between the rib plate and the foot of the rail. The intermediate layers serve as a damping element to assume the load, distribute it and also have an insulating effect on a signal current. A disadvantage is that the relatively large intermediate layers require a large volume of material. Furthermore, the intermediate layer must be electrically insulated on the one hand while on the other hand it must have good damping qualities. Another disadvantage is that the intermediate layer can creep during railway operation since it is not especially fastened under the rail. Furthermore, when the intermediate layer is designed as an additional component, this also leads to a higher demand in the areas of logistics and handling.

It is therefore the object of the present invention to provide a rail pad, in particular for track superstructures, an intermediate layer, in particular for arrangement underneath a rail, and a side region, in particular for arrangement on an intermediate layer, thus eliminating the above disadvantages.

This object is achieved with a rail pad, a rail pad arrangement an intermediate layer, and a side region according to the claims. Other advantages and characteristics of the invention are set out in the sub-claims, the description and the enclosed figures.

According to the invention, the rail pad, in particular the track superstructure, comprises a substantially level intermediate layer wherein the upper side is designed for arranging on a rail and the lower side for arranging on a sleeper, wherein at least one arrangement region if provided on the upper and/or lower side on which the rail or the sleeper can be arranged and thus brought in contact, wherein the rail pad comprises at least one side region designed such that it is adjacent to the intermediate layer wherein the at least one side region is provided with an engaging section for arranging it on the sleeper, and wherein the fastening section is directly and/or indirectly designed to fasten the rail. The track superstructure or the superstructure of a railway line consists of the track bed and the rails mounted to it. A substructure forms a firm base for the construction of the superstructure since it equalizes the unevenness of the terrain. The superstructure and in particular the rail pad serve to absorb and distribute the forces of mass, acceleration, the sinusoidal motion and the velocity of the rolling stock and the thermal stresses caused by the weather. On this "crushed stone superstructure", sleepers are laid transverse to the direction of travel on which the rails are fastened in the direction of travel. The sleepers which are usually made of concrete, but often also of wood or steel, hold the rails at a prescribed distance to each other, and in the case of endlessly welded rails they must also transfer their thermally induced longitudinal expansion into the substructure. On the sleepers, the rails are also held by fastening means or rail fastening means (also called rail fastening systems). Advantageously, the side region is substantially extending away from the rail while the intermediate layer extends below the rail foot and is designed such that the intermediate layer extends exclusively under the rail foot and is therefore not arranged laterally beside it. The intermediate layer can also extend under the complete rail foot. In that case, the intermediate layer preferably comprises two side regions which extend on both sides of the intermediate layer. As a preferred alternative, the intermediate layer does not extend along the entire width of the rail foot. In that case, two rail pads are arranged opposite each other on one rail. In preferred embodiments, the intermediate layer extends about 10% to 50% under the rail foot. One width of the intermediate layer substantially transverse to a rail direction advantageously lies in a range of about 20 to 100 mm, preferably at about 25 to 60 or 70 mm. That embodiment is called "rail pad arrangement" and will be described in detail below. In principle, a distinction is made whether the rail pad is in one or in two parts. Advantageously the rail pad is designed in one piece, which means that the intermediate layer is preferably provided with at least one side region, wherein the intermediate layer or at least the side region is in one piece. As another preferred alternative the intermediate layer or at least a side region can also be form-fittingly and/or force-fittingly connected, such that the rail pad is always in two parts. It should be pointed out here that a rail pad with a firmly bonded connection between the intermediate layer and the at least one side region can be interpreted as a one-piece or two-piece rail pad, depending on the design. Preferably, the upper side of the intermediate layer is designed for direct or indirect disposal on the sleeper. It is to be understood that preferably, the lower side extends into the side region. The side region can also be directly or indirectly attached on the sleeper. Advantageously, the engaging section is designed as a projection and/or recess thus using the engaging section to prevent the displacement of the rail pad relative to the sleeper. In particular, this can prevent the "creeping" of the intermediate layer. Such a projection can advantageously engage in a recess of the sleeper. Also advantageously, the engaging section can be designed as a fastening section in the form of a drill hole or opening or the like via which the rail pad can be form-fittingly and/or force-fittingly fastened and/or firmly bonded to the sleeper by means of a suitable fastening means such as a screw. Suitably, the side region has at least one engaging section, i.e. advantageously also 2, 3, 4, 5, 6 or even more. Advantageously, the fastening section is designed for direct and/or indirect fastening to the rail. In a preferred embodiment, the fastening section is formed as a limiting element or includes a limiting element designed to limit a movement of the rail substantially across the longitudinal direction. Therefore the limiting element contacts the rail, thus fixing and stabilizing it in that way. It is especially advantageous when the fastening element (or also the entire side region) is made of an insulating material to ensure that the current-carrying rail is insulated. In that case, the fastening section fastens the rail directly. It is to be understood that the fastening section can also be designed to fasten the rail indirectly. Therefore, the fastening section does not necessarily have to contact the rail but can be part of a rail connection system. Especially preferred is the direct arrangement of the rail on the intermediate layer or the direct arrangement of the intermediate layer on the sleeper. For this, the intermediate layer preferably comprises the arrangement region in which the rail or the sleeper can be arranged. Substantially, the arrangement region serves to provide other material characteristics. The arrangement region can be designed parallel and level to the upper side and/or the lower side, in which case it practically represents a certain section of the upper or lower side. However, the arrangement region can also be designed as a projection and/or recess relative to the upper side or lower side. A preferred alternative is to have at least part of the intermediate layer extend under the side region. In that case, the intermediate layer is positioned adjacent and transverse to the rail pad that is parallel to the intermediate layer. Advantageously in that case the engaging section of the side region is formed on the intermediate layer on the part of the intermediate layer that is positioned under the rail. Advantageously, an arrangement region formed as a "pad" or "insert" can be inserted in the bowl. The bowl can prevent the intermediate layer from slipping in that a (raised) rim of the bowl serves to limit the arrangement region arranged within. Furthermore, the arrangement region can easily be exchanged, or advantageously to the left and right of the rail, various stiff arrangement regions can be inserted or arranged at random. It is to be understood that the said "pad" or "insert" does not necessarily and not only have to be of the same material as the arrangement region. Such a pad can also be formed as an intermediate layer which comprises at least one arrangement region. In other words, it would then be a two-part intermediate layer. Also advantageously, the side region or the fastening section can extend under the rail and form the bowl in which the intermediate layer, which has an arrangement region, can be placed. Possible embodiments will be described below.

Advantageously, the side region is form-fittingly and/or force-fittingly incorporated and/or firmly bonded in a rail fastening system, in particular in an angular guide plate and/or in part of a fastclip fastening system. Therefore, advantageously, the intermediate layer is designed as part of a rail fastening system. Advantageously, the intermediate layer is incorporated in a rail fastening system. A rail fastening system common in Germany is the superstructure W on concrete sleepers. For the arrangement of a rail, each sleeper has two W-shaped recesses into which the angular guide plates of steel or plastic are placed. Between the angular guide plates, the rail on a corresponding intermediate layer stands directly on the sleeper with the entire width of its foot. The angular guide plates and so-called epsilon [Y] rail clamps are screwed into the rail's plastic dowels, each with two sleeper screws. At the foot, the rails are held by the epsilon clamps pushed together during installation. Alternatively there are also systems using no screws such as the fastclip system. In it, the rail and the sleeper are braced together with a clip. Two such clips are arranged opposite each other on a rail. Between the rail and the (concrete) sleeper is an intermediate layer that is held between the two clips. In the said systems, the intermediate layer is always a separate component. It is therefore a big advantage that the intermediate layer according to the invention comprises at least one side region designed to adjoin the intermediate layer. In a preferred embodiment, the side region is an angular guide plate of a rail fastening system. Another preferred version is for the side region to be an insulating element such as a sidewall insulator of a fastclip system or another suitable component of a fastclip system. Advantageously, this can reduce the number of components needed to fasten the rail when the intermediate layer, for example, is incorporated in an angular guide plate or in an insulator of a fastclip system. Specifically, the type of superstructure or rail fastening system is irrelevant. For example, the following rail fastening systems can be used: Superstructure KS, W, K, Pandrol Pr, L, Hambo fastening, Heyback, Nebelung-Bau, Fastclip, E-Clip, Hf, N, F, H, Double Clamp Nail, Fng, F, N 41, H or Hs. Thanks to the direct connection with the rail fastening system, for example via the engaging section of the side region, "creeping" of the rail pad or the intermediate layer is impossible. The intermediate layer is fixed or locked through the side region in longitudinal direction which substantially corresponds to the direction of travel. Creeping, in other words shifting or slipping, is therefore no longer possible. Advantageously, such an intermediate layer can be easily exchanged. The attached rail fastening arrangement can also be especially marked (marking with a colour code depending on the stiffness of the intermediate layer). This also allows the asymmetrical rail placement in the track (e.g. in a curve). In case of a multi-component system, the rail fastening system including the intermediate layer can be produced in one step (thus reducing the cost of tooling). Furthermore, in case of a rubber and plastic composite, the finishing process can be eliminated. The form seals itself with the plastic which prevents burring. Since the intermediate layer does not have to extend under the entire width of the rail foot, material can be saved.

Advantageously, the engaging section is oriented away from the lower side and substantially oriented in the direction of the sleeper. Suitably, the engaging section is also formed as a projection. The projection can be a pin with a round, oval, elliptical, circular or angular cross section. Such a pin can also be hollow, i.e. have an opening, for example to accommodate a bolt or a screw. Preferably, the sleepers have corresponding recesses and/or holes in which the engaging section can engage.

Advantageously, the engaging section also substantially extends in longitudinal direction. Looking across the longitudinal direction, the engaging section advantageously has a triangular or rectangular cross section, wherein the corners are not necessary sharp-edged but preferably rounded. It is to be understood that the engaging section can also be formed as a pin, web, nub or the like, i.e. that it does not substantially extend in longitudinal direction. Advantageously instead, a number of such engaging sections is arranged in succession in longitudinal direction and/or also across this direction.

Advantageously, the intermediate layer is made of a first material and at least an arrangement region is made of a second material, and wherein the first material is harder than the second material. Advantageously, the intermediate layer is made of ethylene vinyl acetate (EVA), i.e. advantageously, the first material is EVA. Very preferably, the material of the intermediate layer is the same as that of the side region. It is also preferred that the intermediate layer can be made of a different material than the side region. Preferably the second material is a thermoplastic elastomer (TPE). Alternatively, the second material consists of cross-linked elastomers on the basis of natural rubber (NR), styrene, butadiene rubber (SBR) or ethylene propylene diene monomer (EPDM) in compact form or as foam. Furthermore, the second material can consist of mixtures of the above named materials. Advantageously, a multiple number of arrangement orders can be provided, such as two, three, four, five, six, seven, eight, nine, ten or more. The arrangements can be full-surface, striped and/or nubbed. Preferably, the arrangements are applied at least to the upper side or the lower side.

Preferably, the arrangements are applied to the upper side and the lower side. Advantageously, this can provide the rail pad with a defined stiffness.

Advantageously, at least one arrangement region is formed as a projection which substantially extends transverse to the intermediate layer. The projection can be formed as the said nub. Such a projection can be formed with a cross section extending substantially parallel to the intermediate layer, roundish, round and/or also angular, in particular also polygonal. Especially preferred is a substantially circular cross section. However, depending on the application, an elliptical or oval shape may also be an advantage. In a cross section extending substantially transverse to the intermediate layer, the projection is advantageously quadrangular, rectangular or also polygonal. Advantageously, the cross section can, for example, also be round or semi-circular. It is to be understood that the projection can be formed on the upper side and/or the lower side. Furthermore, no projection may be formed, i.e. the arrangement regions formed of the second material are flush with the upper side and/or the lower side. In this design, the arrangement regions advantageously extend into the intermediate layer. It is to be understood that at least one arrangement region can also be formed continuously, i.e. continuing from the upper side to the lower side. Advantageously, the first material is also electrically insulating. Also advantageously, a functional separation can be provided between the intermediate layer and the arrangement region, wherein the arrangement region substantially dampens the rail while the intermediate layer provides the electrical insulation.

Advantageously, the rail pad substantially extends in a longitudinal direction which corresponds to the direction of travel, wherein the intermediate layer comprises a holding section that limits the arrangement region substantially across the longitudinal direction. Advantageously, the holding section therefore prevents the rail from shifting across the longitudinal direction. Advantageously, the holding section is provided on both sides of the rail such that the rail is substantially completely fixed across the longitudinal direction. The function of such a holding section therefore corresponds to the said fastening section in its design as a limiting element. The characteristics and advantages named in connection with the limiting element, especially, for example, the insulating characteristics, apply equally to the holding section.

Suitably, the holding section has a height substantially transverse to the upper side wherein the ratio of height to the thickness of the intermediate layer is in the range between about 0.5 and 3.0. It is especially advantageous when the range is between 0.8 and 2.5. These ranges apply equally to the fastening section designed as a limiting element. Preferably, the thickness of the intermediate layer is in a range between about 0.5 and 5 mm, especially in a range between about 1.0 and 3.0 mm. Preferably, the height of the arrangement region formed as a projection, which is measured substantially across the upper and lower side, is in a range between about 1.0 and 15.0 mm, especially in a range between about 2.0 and 9.0 mm. Preferably, a ratio between the height of the projection and the thickness of the intermediate layer is in the range between about 75 and 1/5, especially in a range between about 9 and 2/3, and even more especially in a range of about 3 to 2.

Preferably, the rail pad is provided with at least one recess which substantially extends in longitudinal direction and which forms at least one connecting web which extends substantially transverse to the longitudinal direction. It is to be understood that a recess is suitably present only when it is a rail pad or an intermediate layer with at least two side regions extending on both sides of a rail. Suitably, the recess substantially extends in the intermediate layer substantially in the middle below the rail or substantially in the middle between the side regions. Advantageously, the connecting web prevents the rail pad from twisting parallel and/or transverse to a track plane extending substantially parallel to the rail pad. Also advantageously, the connecting web so to speak serves as a spacer or to set and/or adapt to the width of the rail. Related to the longitudinal direction, the at least one connecting web can be provided at any point, for example viewed in longitudinal direction approximately centered or recessed. It is to be understood that one, two, three, four or more connecting webs can be provided. Advantageously, material can be saved thanks to the recess(es). Preferably, the recess can also be formed as an opening or hole in the intermediate layer; advantageously a number of recesses can be provided. The connecting web can also have a dividing line or a contact region which so to speak forms a connection between two rail pads. Such an embodiment is also described below as a rail pad arrangement.

According to the invention, a rail pad arrangement is provided with two rail pads according to the invention, each of which has one side region, and whose intermediate layers can be arranged substantially parallel to each other transverse to the longitudinal direction. It is a great advantage that on the two sides of the rail, rail pads or intermediate layers of different stiffness can be used. This can be an advantage especially in curves or bends, since the forces applied to the substructure in these areas, and also the wear in the intermediate layers can be influenced.

Advantageously, the two rail pads and in particular in the region of the intermediate layers, form a contact region at which the two rail pads touch. Preferably the contact region is formed as a kind of dividing line which extends substantially in longitudinal direction and is substantially arranged in the middle of the rail foot. It is to be understood that the dividing line must not necessarily run parallel to the longitudinal direction, but that it may have a diagonal form and/or for example a meandering form. The two rail pads can be form-fittingly and/or force-fittingly connected or firmly bonded in the contact region. As an advantageous alternative, they may not connect but only touch or be slightly spaced apart in which case the space can be at least partly closed when the rail pads move toward each other. Advantageously, the contact region can prevent that the rail pad shift toward each other in longitudinal direction, for example when the two rail pads engage into each other, e.g. via a kind of wave-shaped and/or tooth-shaped profile.

Advantageously, the rail pads are connected via at least one connecting web, with a clearance. In particular the connecting web can be part of the intermediate layer(s), i.e. it can be made of the same material as the intermediate layer. Advantageously, the connecting web is made of a material that is stiffer than the first and/or the second material. The connecting web can also be made of a completely different material such as steel. A big advantage of the connecting web is that it can prevent the twisting or distortion of the rail pad arrangement substantially parallel to the track plane. Starting out from a centre line, which substantially extends transverse to the longitudinal direction and is positioned substantially in the middle of a rail pad, the at least one connecting web of a rail pad has a clearance in longitudinal direction at a distance "x" (where x is the spacer for a measure of length). Advantageously, the connecting web of a rail pad, which is to be arranged opposite the said web, has a clearance "x", starting out from the centre line. It is to be understood that the clearance does not have to be exactly "x". In principle it is enough if the clearance "x" is taking the dimensions of the connecting web into account. Advantageously, this results in a rail pad arrangement which has two connecting webs in longitudinal direction, wherein the connecting webs are offset to each other. Suitably, each connecting web touches the opposite intermediate layer via a connecting region, thus supporting itself. As a preferred alternative the connecting webs of two opposite rail pads can also form the contact region, i.e. contact or abut each other. In that case, the clearance between the two connecting webs would be about "x", starting out from the centre line. It is to be understood that the length of the connecting webs would be correspondingly shorter than with the embodiment named earlier, since the clearance of the rail pads doubles due to the connection webs arranged side by side. The above embodiments also apply if each rail pad has more than one connecting web.

Advantageously, the connecting web is form-fittingly and/or force-fittingly connected with and/or firmly bonded to at least one of the rail pads. Advantageously, the connecting web is therefore exchangeable. Thus, the clearance of the two rail pads can be adjusted and adapted to different rail widths over a length of the connecting web which extends substantially transverse to the longitudinal direction (direction of travel). It is to be understood that such a connecting web is not absolutely necessary. Twisting of the rail pads on the sleeper or in relation to the rails can also be advantageously prevented when the engaging sections of the side regions are designed such that the rail pad cannot twist in relation to the sleeper.

According to the invention, an intermediate layer, in particular for arrangement under a rail, comprises an upper side and a lower side, wherein the upper side is formed to be arranged on a rail and the underside to be arranged on a sleeper, wherein at the upper side and/or at the lower side at least one arrangement region is provided on which the rail or the sleeper can be arranged, wherein the intermediate layer comprises a connecting region on which a side region can be arranged.

According to the invention, a side region, in particular for arrangement on an intermediate layer, is provided with an engaging section and/or a fastening section, wherein the engaging section is designed to be arranged on a sleeper and wherein the fastening section is designed to be arranged directly and/or indirectly on a rail, wherein the side region comprises a connecting region on which an intermediate layer can be arranged. In other words, the intermediate layer and the side region can act in combination via the connecting region. This can be of advantage when the side region is to be made of another material than the intermediate layer. For fastening via the connecting region, suitable fastening means such as dowels and/or screws and/or firmly bonded connections or the like can be provided. Also advantageous would be a firmly bonded connection, for example a fused or vulcanized connection or—if the connection regions are of metal—a welded connection. Otherwise, the advantages and characteristics mentioned in connection with the rail pad and the rail pad arrangement also apply to the intermediate layer and the side region.

It is to be understood that all advantages and characteristics of the rail pad according to the invention also apply to the rail pad arrangement according to the invention, the intermediate layer according to the invention and the side region according to the invention, as well as vice versa and in relation to each other.

Figure 2:
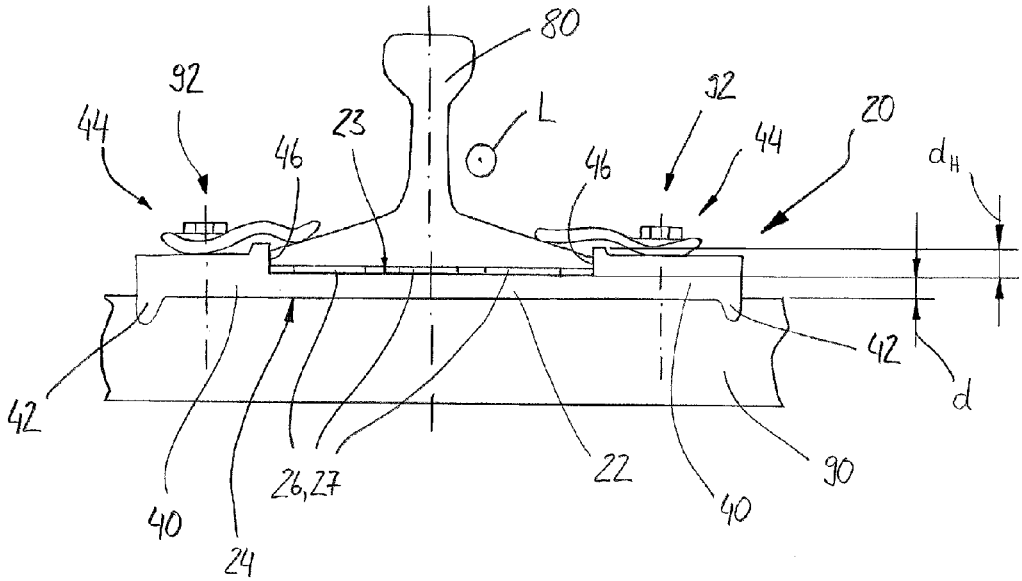
Figure 3A:
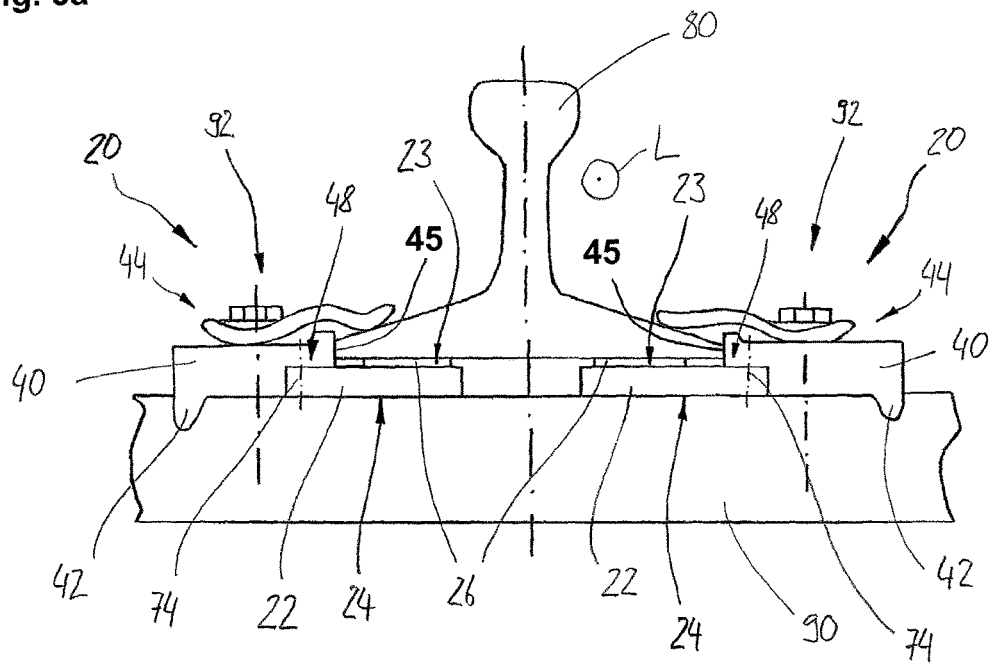
Figure 3B:
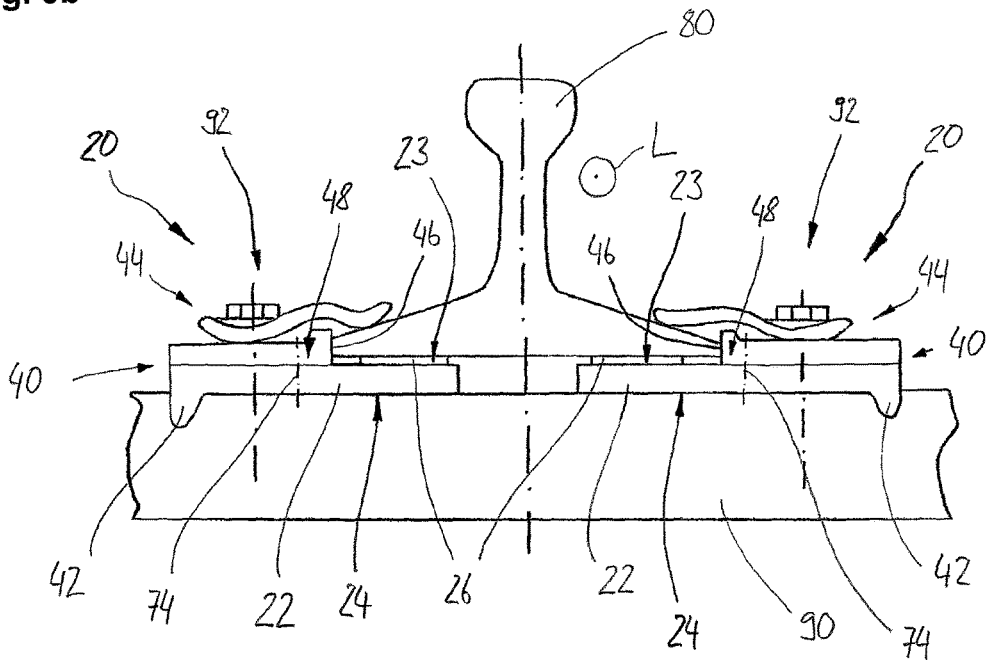
Figure 4A:
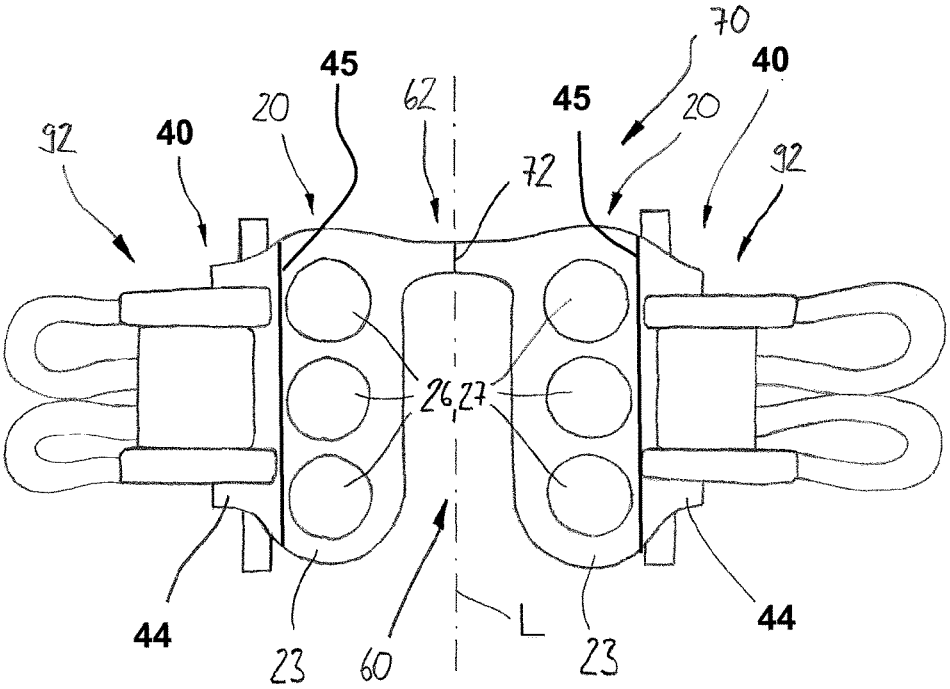
Figure 4B:
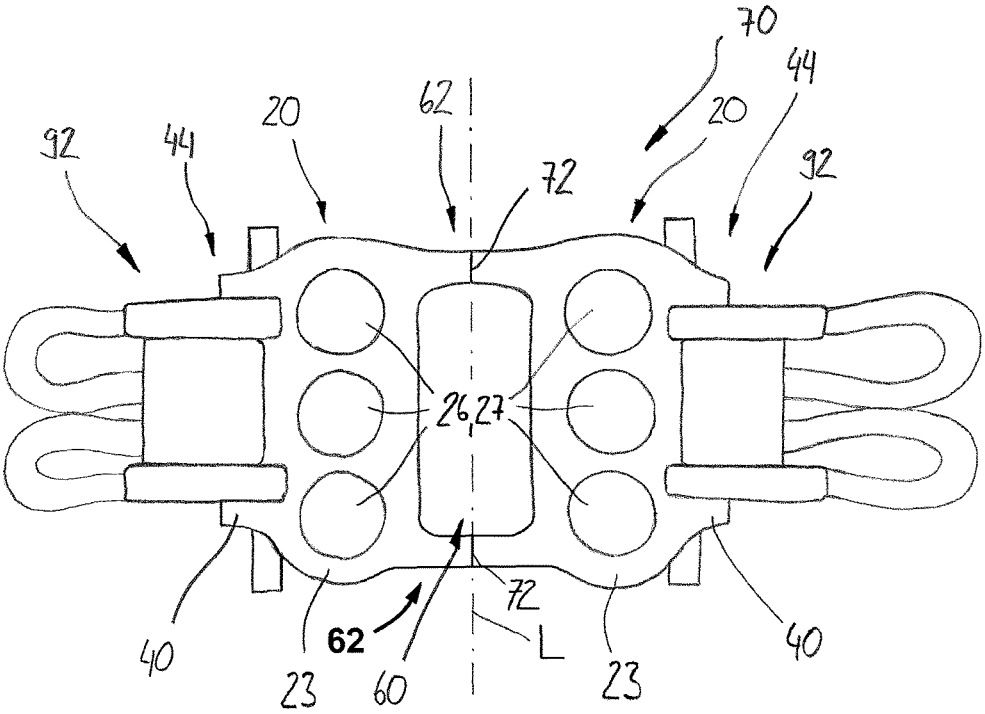
Figure 5:
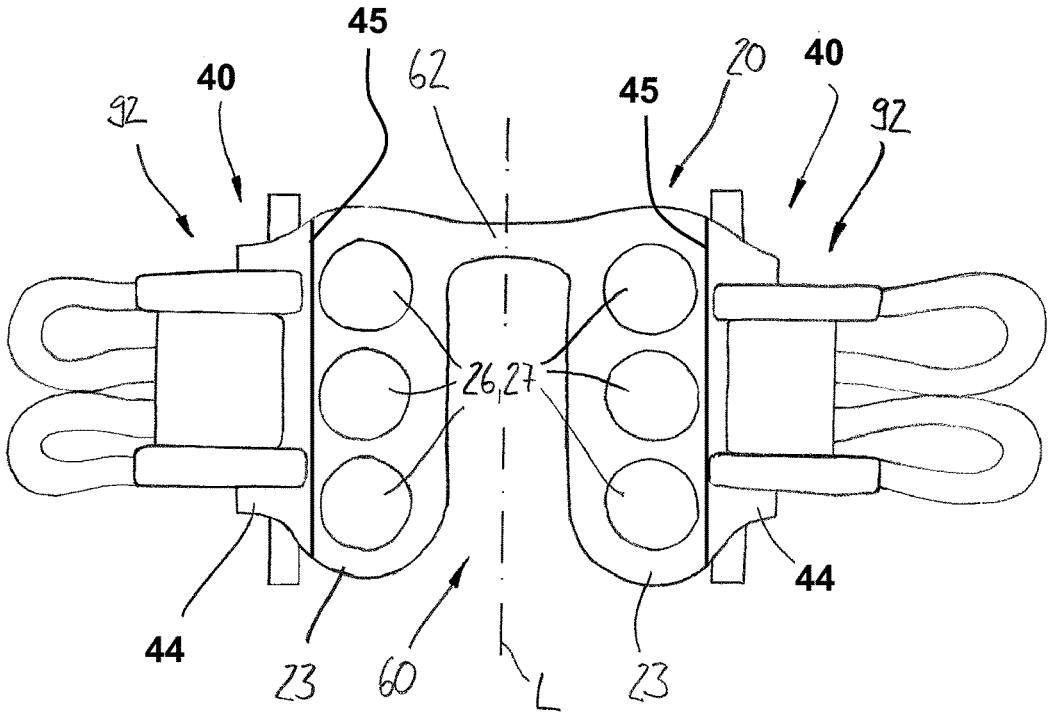
Figure 6A:
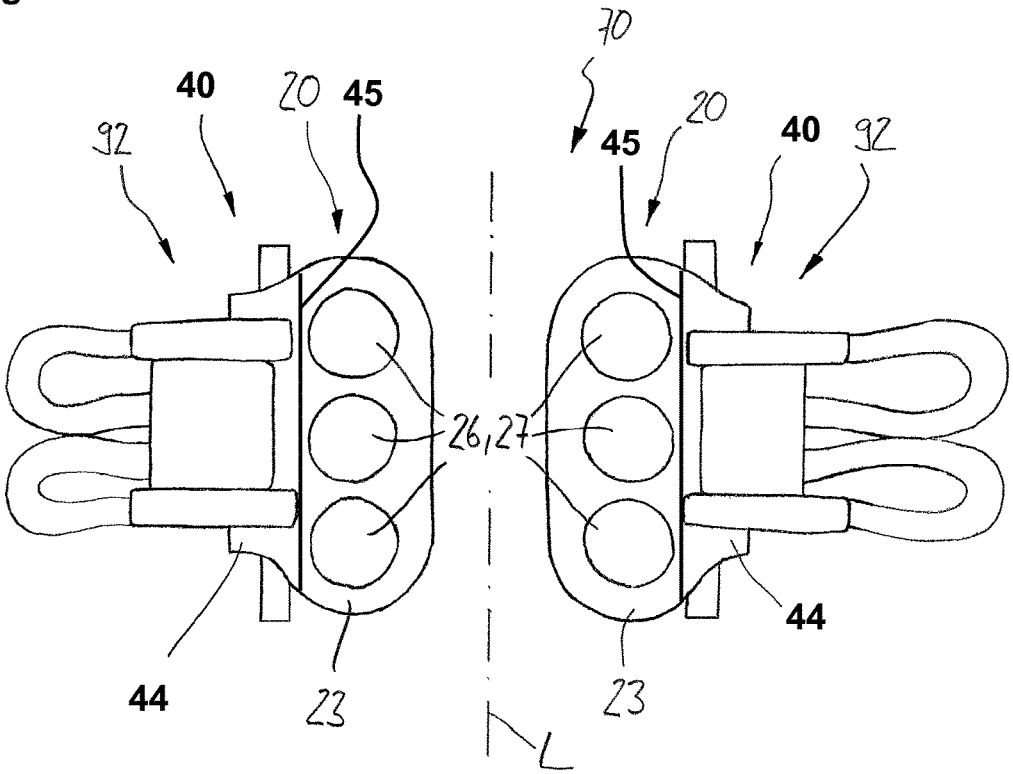
Figure 6B:
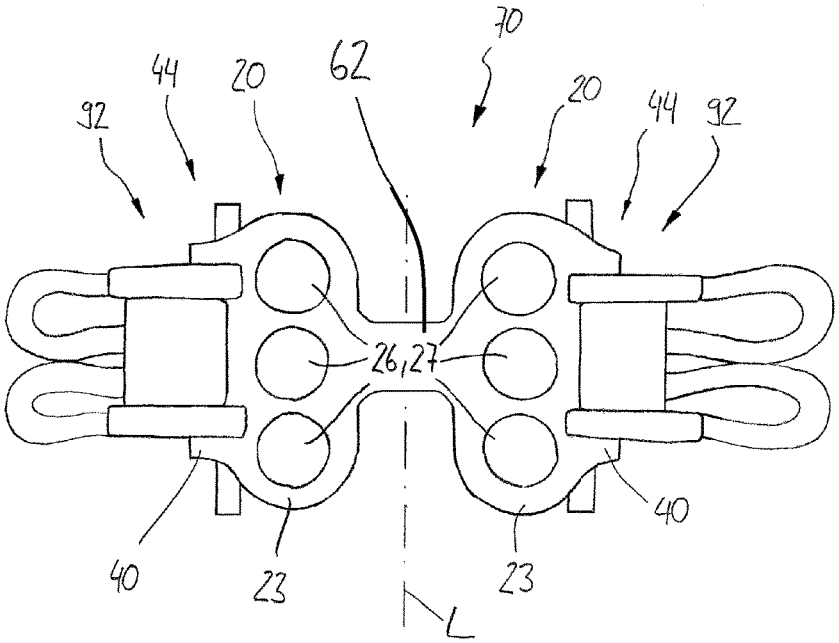
Figure 7:
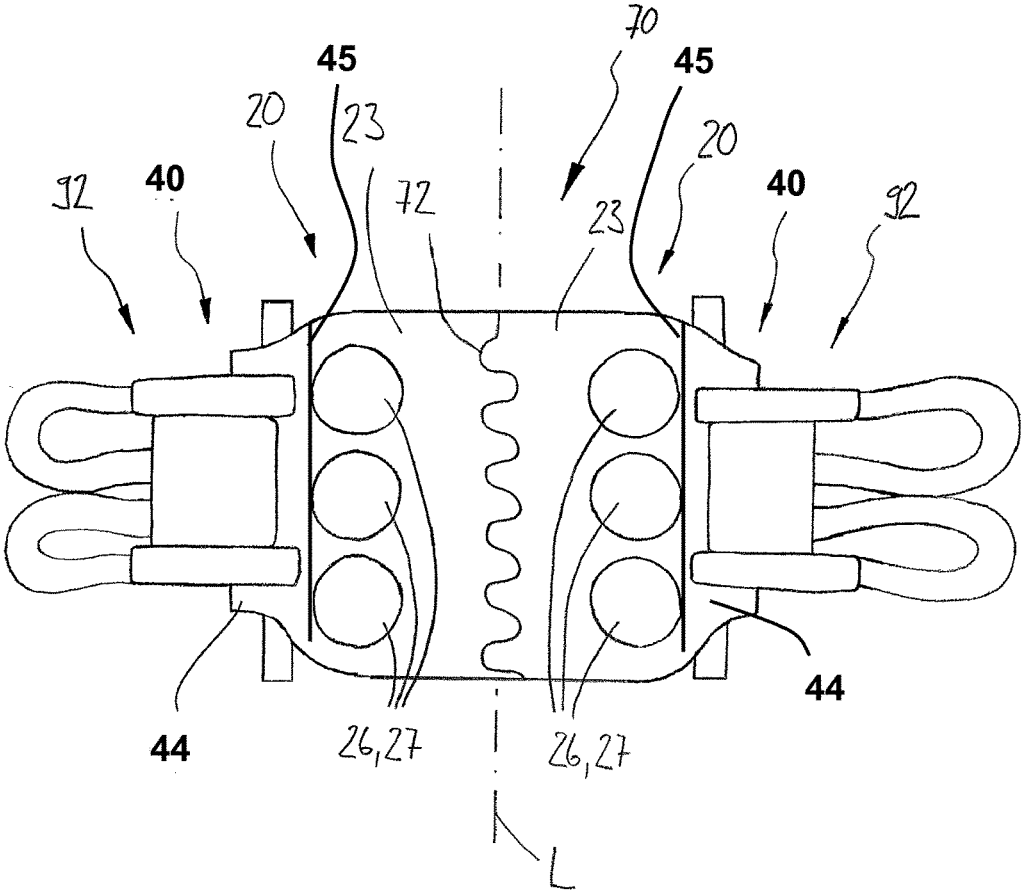
Figure 8A:
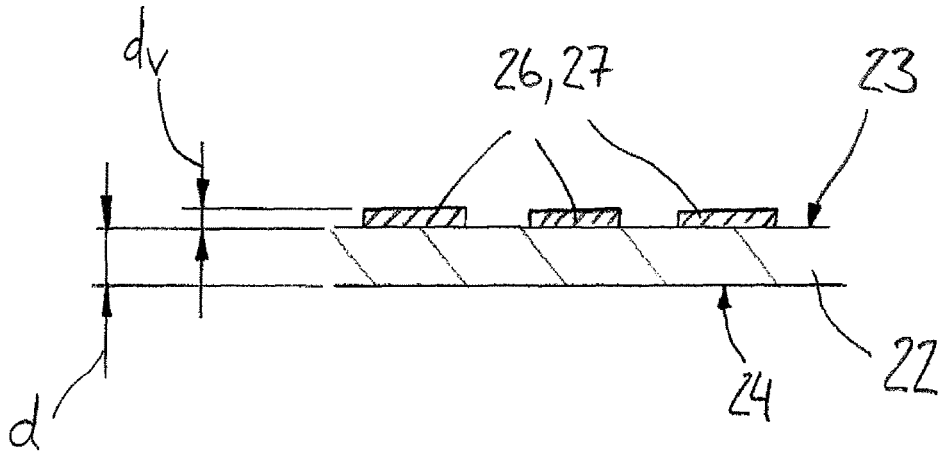
Figure 8B:
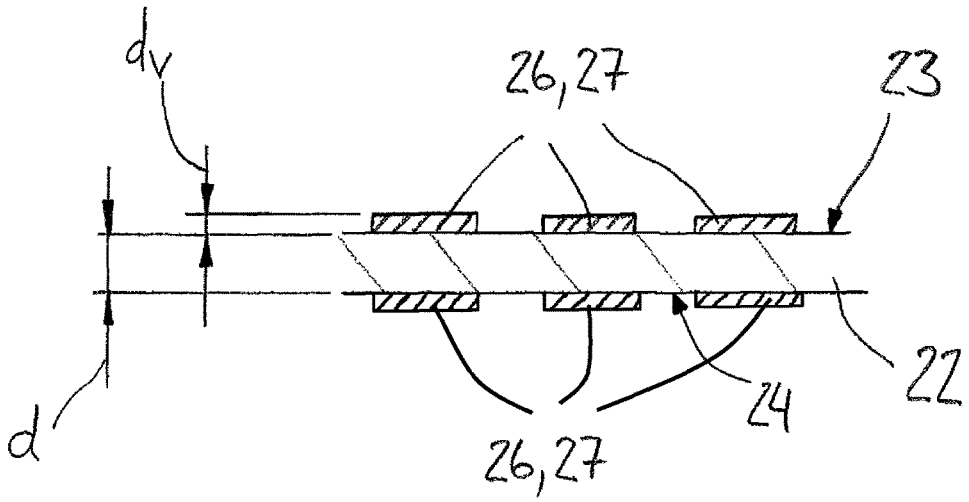
Figure 8C:
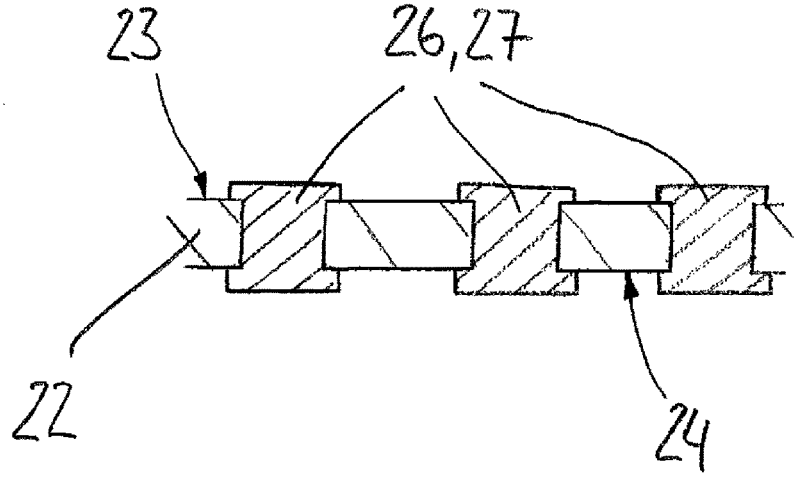
Figure 8D:
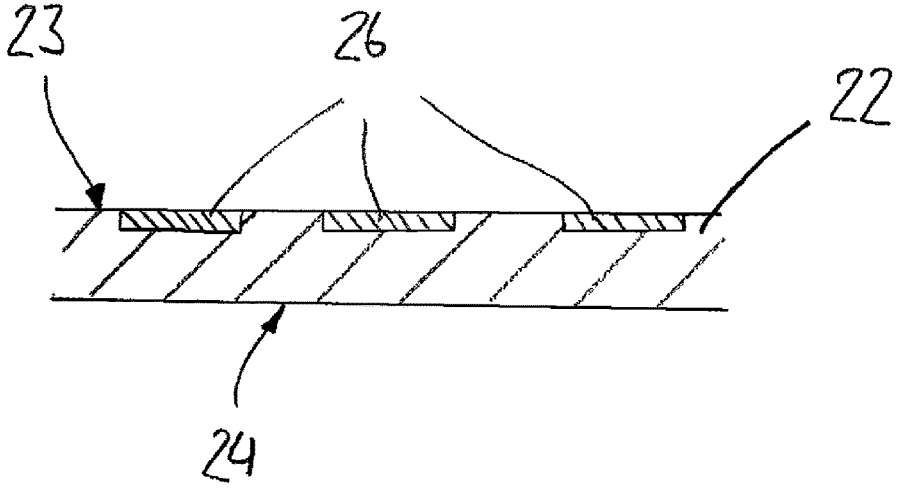
Figure 8E:
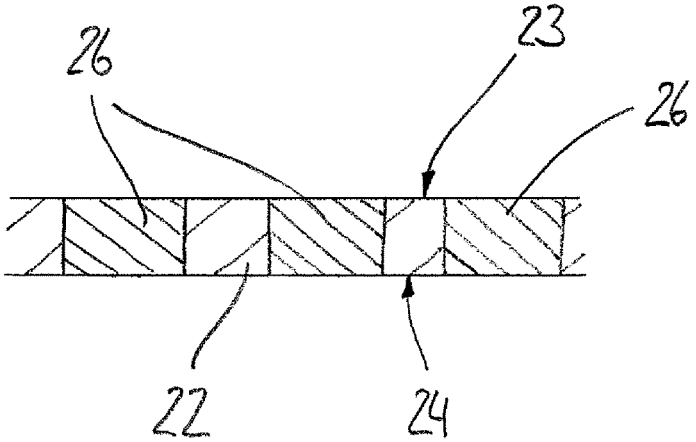
Figure 8F:
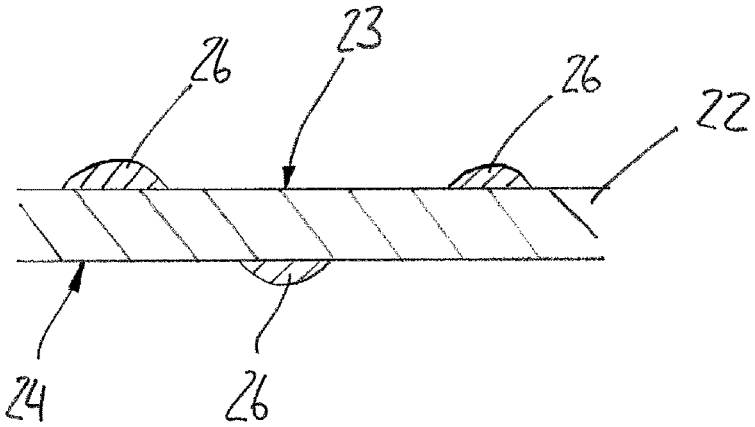

Further advantages and characteristics result from the following description of preferred embodiments of the rail pad according to the invention, the rail pad arrangement according to the invention, the intermediate layer according to the invention and the side region according to the invention, with reference to the enclosed figures. Individual characteristics of the individual embodiments can be combined with each other as part of the invention. By making reference to the figures, FIG. 1 shows a preferred embodiment of a rail pad arrangement consisting of two rail pads;

FIG. 2 shows a preferred embodiment of a rail pad seen across the longitudinal direction;

FIG. 3*a* shows a preferred embodiment of two intermediate layers and two side regions;

FIG. 3*b* shows a preferred embodiment of a continuous intermediate layer;

FIG. 4*a* shows a top view of a preferred embodiment of a rail pad arrangement;

FIG. 4*b* shows a preferred embodiment of a rail pad arrangement with two connecting webs;

FIG. 5 shows a top view of a preferred embodiment of a rail pad;

FIG. 6*a* shows a top view of a preferred embodiment of a rail pad arrangement;

FIG. 6*b* shows a preferred embodiment of a rail pad arrangement with a centrally arranged connecting web;

FIG. 7 shows a preferred embodiment of a rail pad arrangement provided with a contact region;

FIG. 8*a* shows a preferred embodiment of an intermediate layer with three arrangement regions formed as projections;

FIG. 8*b* shows a preferred embodiment of an intermediate layer with three arrangement regions formed as projections on the upper side and on the lower side;

FIG. 8*c* shows a preferred embodiment of an intermediate layer with continuous arrangement regions;

FIG. 8*d* shows a preferred embodiment of an intermediate layer with three flush arrangement regions;

FIG. 8*e* shows a preferred embodiment of an intermediate layer with three continuous and flush arrangement regions;

FIG. 8*f* shows a preferred embodiment of an intermediate layer with three semi-circular arrangement regions.

FIG. 1 shows a preferred embodiment of a rail pad arrangement 70 consisting of a left and a right rail pad 20. This is a cross-sectional presentation where—as in some of the following figures—hatching is dispensed with for the sake of clarity. Between the two rail pads 20, a rail 80 is arranged on the two arrangement regions 26 which are formed as projections 27. The arrangement regions 26 extend from the upper sides 23 of the intermediate layer 22 in the direction of rail 80. Over their lower sides 24, the intermediate layers 22 are arranged on a sleeper 90. Each of the two rail pads 20 are provided with side regions 40 which have engaging sections 42. The engaging sections 42 engage in the corresponding recesses (without reference number) of sleeper 90. It can be clearly seen that the intermediate layers 22 are continuously connected with the side regions 40, wherein the side regions 40 are incorporated in the rail pad arrangements 92. In particular in the preferred embodiment shown in FIG. 1 the side regions 40 are designed as angular guide plates (such as in superstructure W). It is clearly seen that substantially the intermediate layers 22 transverse to a longitudinal direction L, which extends substantially in the direction of travel, are not arranged below an entire width of rail 80. Across the longitudinal direction L, the rail 80 or the foot of rail 80, is held by corresponding holding sections 46 which substantially extend across the upper sides 23 of the intermediate layers 22.

FIG. 2 shows a preferred embodiment of a rail pad 20 which comprises two side regions 40 and an intermediate layer 22. The rail pad 20 is arranged on a sleeper 90 via a lower side 24. On an upper side 23 are three arrangement regions 26 formed as three projections 27 which serve to arrange a rail 80. The side regions 40 each comprise an engaging section 42 and fastening sections 44 which are incorporated in the rail fastening systems 92, also formed as angular guide plates. Across a longitudinal direction L, the rail pad 20 or the intermediate layer 22 each form two holding sections 46 which fix the rail 80 across longitudinal direction L. Substantially parallel to the sleeper 90, the intermediate layer 22 has a thickness d, and the holding section(s) 46 has/have a height $d_H$.

FIG. 3*a* shows a preferred embodiment of two intermediate layers 22 and two side regions 40. The design substantially corresponds to the embodiments known from FIGS. 1 and 2. One difference is that the rail pad 20 is not in one piece but consisting of an intermediate layer 22 and a side region 40. The side regions 40 and the adjacent intermediate layers 22 are connected via the connecting regions 48 and connecting means 74. The connecting means 74 are only sketched as a dotted line in the embodiment shown in FIG. 3*a*. This could be conceived as a form-fittingly and/or force-fittingly and/or a firmly bonded connection. The two side regions 40 each form a fastening section 44 in the form of a limiting element 45. Furthermore, each side region 40 comprises a fastening section 44 which serves to indirectly fasten a rail 80 via a rail clamp (without reference number).

FIG. 3*b* shows the embodiment known from FIG. 3*a* of two rail pads, wherein intermediate layers 22 are continuous and extend under the side regions 40. The engagement sections 43 are consequently formed on the intermediate layers 33 or their undersides 24.

FIG. 4*a* shows a rail pad arrangement 70 consisting of two rail pads 20 adjoining each other via a contact region 72, thus forming connecting web 62. The rail pads 20 each have three arrangement regions 26 formed as projections 72 which extend away from upper sides 23 of corresponding intermediate layers (without reference number in FIG. 4*a*). The rail pads 20 each comprise a side region 40 which are formed as part of rail fastening systems 92, in this case fastclip systems, and incorporated therein. Fastening sections 44 are designed as sidewall insulators of the fastclip systems. In this embodiment the fastening sections 44 have limiting elements 45 or are partly designed as limiting elements 45 which can fix a rail (not shown here) substantially across a longitudinal direction L.

FIG. 4*b* shows the embodiment of a rail pad arrangement 70 known from FIG. 4*a* with two connecting webs 62.

FIG. 5 shows a preferred embodiment of a rail pad 20 on whose upper side 23 a total of six arrangement regions 26 designed as projections 27 are formed. Between the arrangement regions 26, substantially in a longitudinal direction L, is a recess 60 forming a connecting web 62. It is to be understood that for example two connecting webs 62 can be formed. The rail pad 20 has two side regions 40, each of which is part of a rail pad fastening system 92. Otherwise, the description of FIG. 4*a* applies.

FIG. 6*a* shows a preferred embodiment of a rail pad arrangement 70 consisting of two rail pads 20. On their upper side 23, the two rail pads 20 have three arrangement regions formed as projections 27. Each rail pad 20 is provided with a side region 40 which is incorporated by form-fittingly and/or force-fittingly connection and/or bonding to a rail fastening system (92) (in this case a fastclip system).

FIG. 6*b* shows the preferred embodiment of FIG. 61 of a rail pad arrangement 70 with a connecting web 62 formed in the middle, which prevents twisting.

In contrast to the above, FIG. 7 shows a preferred embodiment of a rail pad arrangement 70 with a contact region 72. In longitudinal direction L, the contact region 72 is substantially curved or meandering. Otherwise, the description of FIG. 4*a* applies to the embodiments shown in FIGS. 6*a* and 7.

FIG. 8*a* shows a preferred embodiment of an intermediate layer 22 with a lower side 24 and an upper side 23. On upper side 23, three arrangement regions 26 are formed as projections 27. Substantially across the intermediate layer is a height $d_v$ of the projections and a thickness d of the intermediate layer 22.

FIG. 8*b* shows the preferred embodiment known from FIG. 8*a* of an intermediate layer 22 with a lower side 24 and an upper side 23, wherein arrangement regions 26 on the upper side 23 and on the lower side 24 are formed as projections 27.

FIG. 8*c* shows a preferred embodiment of an intermediate layer 22 with a lower side 24 and an upper side 23. The intermediate layer 22 is divided into three arrangement regions 26, each of which have projections 27 on the upper side 23 and the lower side 24.

FIG. 8*d* shows a preferred embodiment of an intermediate layer 22 with an upper side 23 and a lower side 24. The arrangement layers 26 are flush with upper side 23 and are practically inserted in the intermediate layer 22.

FIG. 8*e* shows a preferred embodiment of an intermediate layer 22 with an upper side 23 and a lower side 24. In the section shown, the intermediate layer 22 is divided into substantially cylindrical arrangement regions 26. It is to be understood that—for example in reference to upper side 23—the arrangement regions can also have any kind of cross section such as oval, elliptical, triangular, quadrangular or generally polygonal.

FIG. 8*f* shows a preferred embodiment of an intermediate layer 22 with an upper side 23 and a lower side 24. A semi-circular arrangement region 26 is formed on the lower side 24. Two semi-circular arrangement regions 26 are formed on the upper side 23.

REFERENCE NUMBERS

26 Rail pad
22 Intermediate layer
23 Upper side
24 Lower side
26 Arrangement region
27 Projection
40 Side region
42 Engaging section
44 Fastening section
45 Limiting element
46 Holding section
48 Connecting section
60 Recess
72 Contact region
74 Fastening means
80 Rail
90 Sleeper
92 Rail fastening system
$d_H$ Height of the holding section
$d_v$ Height of the intermediate layer
d Thickness of the intermediate layer
L Longitudinal direction

The invention claimed is:

1. A rail pad for track superstructures, comprising:

a substantially level intermediate layer having an upper side and a lower side, wherein the upper side is designed for arrangement on a rail and the lower side for arrangement on a sleeper;

two side regions which are adjacent to the intermediate layer; and at least one recess which extends substantially in longitudinal direction and which forms at least one connecting web which extends substantially transverse to the longitudinal direction, wherein on the upper side and/or on the lower side at least one arrangement region is formed on which the rail or the sleeper can be arranged, wherein the at least one arrangement region is formed as projection which substantially extends transversely to the intermediate layer, wherein the side regions are provided with an engaging section and/or a fastening section, wherein the engaging section is designed to be arranged on the sleeper, and wherein the fastening section is designed to directly and/or indirectly fasten the rail, wherein the engaging section is oriented away from the lower side and substantially in the direction of the sleeper.

2. The rail pad according to claim 1, wherein the intermediate layer does not extend along the entire width of a rail foot.

3. The rail pad according to claim 1, wherein the side region is form-fittingly and/or force-fittingly and/or by firmly bonding incorporated in an angular guide plate and/or in a part of a fastclip fastening system.

4. The rail pad according to claim 1, wherein the engaging section extends substantially in the longitudinal direction (L).

5. The rail pad according to claim 1, wherein the intermediate layer is made of a first material, wherein the at least one arrangement region is made of a second material, and wherein the first material is harder than the second material.

6. The rail pad according to claim 1, wherein the intermediate layer comprises a holding section which limits the arrangement region substantially transverse to the longitudinal direction.

7. The rail pad according to claim 6, wherein the holding section substantially has a height ($d_H$) transverse to the upper side, wherein the ratio of the height ($d_H$) to a thickness (d) of the intermediate layer is at a range between about 0.1 and 0.7.

8. A rail pad arrangement comprising:

two rail pads, each comprising:

one substantially level intermediate layer which has an upper side and a lower side, wherein the upper side is designed to be arranged on a rail and the lower side to be arranged on a sleeper; and a side region which is adjacent to the intermediate layer and wherein the side region comprises an engaging section and/or a fastening section, wherein at least one arrangement region is formed on the upper side and/or on the lower side on which the rail or the sleeper can be arranged, wherein the engaging section is designed to be arranged on the sleeper, and wherein the fastening section is designed to be directly or indirectly fastened to the rail, wherein the engaging section is oriented away from the lower side and substantially in the direction of the sleeper, and wherein the rail pads are connected by at least one connecting web with a clearance.

9. The rail pad arrangement according to claim 8, wherein the two rail pads form a contact region at which the two rail pads touch.

10. The rail pad arrangement according to claim 9, wherein the connecting web is positively and/or nonpositively connected and/or bonded to at least one rail pad.

* * * * *